US006435502B2

(12) United States Patent
Matos

(10) Patent No.: US 6,435,502 B2
(45) **Date of Patent: *Aug. 20, 2002**

(54) ENCODED IMAGE PUZZLE/DECODER

(76) Inventor: Jose R. Matos, 8108 Fleetwood Dr., Plano, TX (US) 72025

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/326,791

(22) Filed: Jun. 4, 1999

Related U.S. Application Data

(60) Provisional application No. 60/088,138, filed on Jun. 5, 1998.

(51) Int. Cl.[7] ..... A63F 9/08
(52) U.S. Cl. ..... 273/157 R; 273/153.5
(58) Field of Search ..... 273/153 S, 157 R, 273/157 A, 153 R; 380/54, 56

(56) References Cited

U.S. PATENT DOCUMENTS 799,609 A * 9/1905 Ludwig ..... 273/157 A
1,415,625 A * 5/1922 Bulister ..... 273/153 S
3,473,807 A * 10/1969 Leonard ..... 273/157 R
3,969,830 A * 7/1976 Grasham ..... 380/54
4,605,231 A * 8/1986 Richman ..... 273/157 A
4,714,275 A * 12/1987 Engel et al. ..... 446/147
4,815,742 A * 3/1989 Augustine ..... 273/157 A
5,401,032 A * 3/1995 Barnhart et al. ..... 273/306
5,651,547 A * 7/1997 Rannelli ..... 273/157 R
5,715,316 A * 2/1998 Steenblik et al. ..... 273/157 A
5,769,418 A * 6/1998 Gilbert et al. ..... 273/157 A

* cited by examiner

*Primary Examiner*—Steven Wong
(74) *Attorney, Agent, or Firm*—Rick Matos; Innovar, L.L.C.

(57) ABSTRACT

A puzzle/decoder for decoding and viewing lens resolvable encoded images. The decoder includes an encoded image which can be decoded with one or more decoding lenses. A retainer is also included in the decoder for retaining the decoding lenses in proximity to the encoded image borne by the substrate. A decoded image is formed when a lens adapted to decode a particular encoded image is slid over the encoded image. The decoder can be a substantially flat slide puzzle, a cylindrically shaped slide puzzle, an enclosed puzzle with freely moving decoding lenses therein, a puzzle shaped as a three-dimensional object or a combination puzzle including two or more individual puzzles.

45 Claims, 11 Drawing Sheets

Fig. 1a
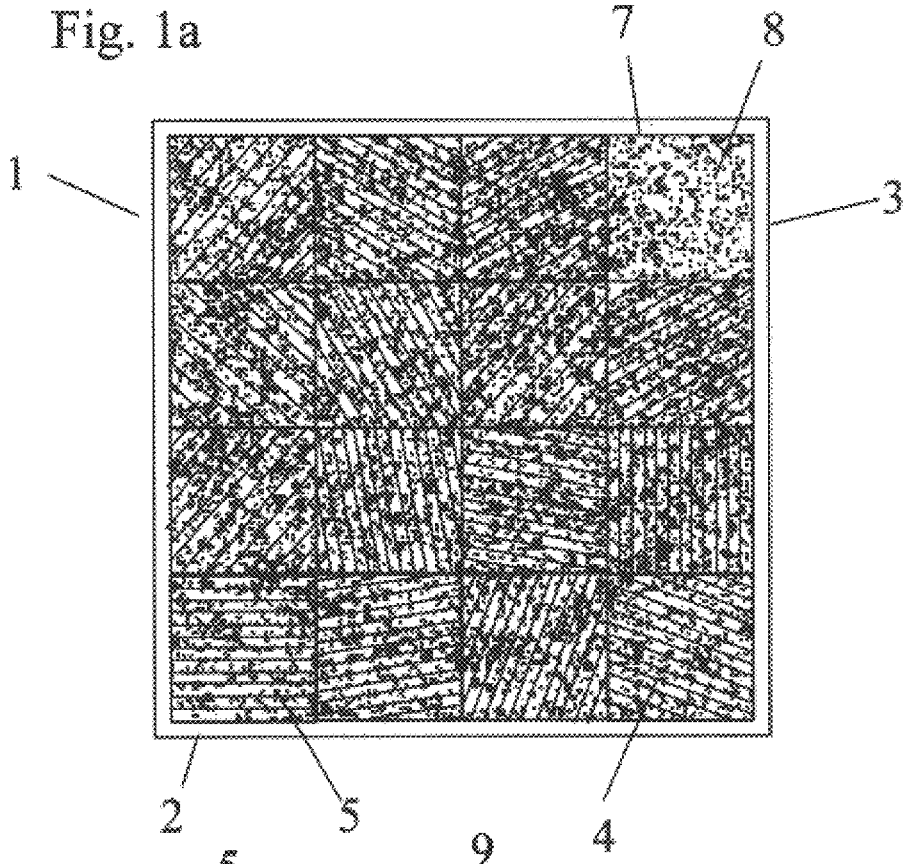
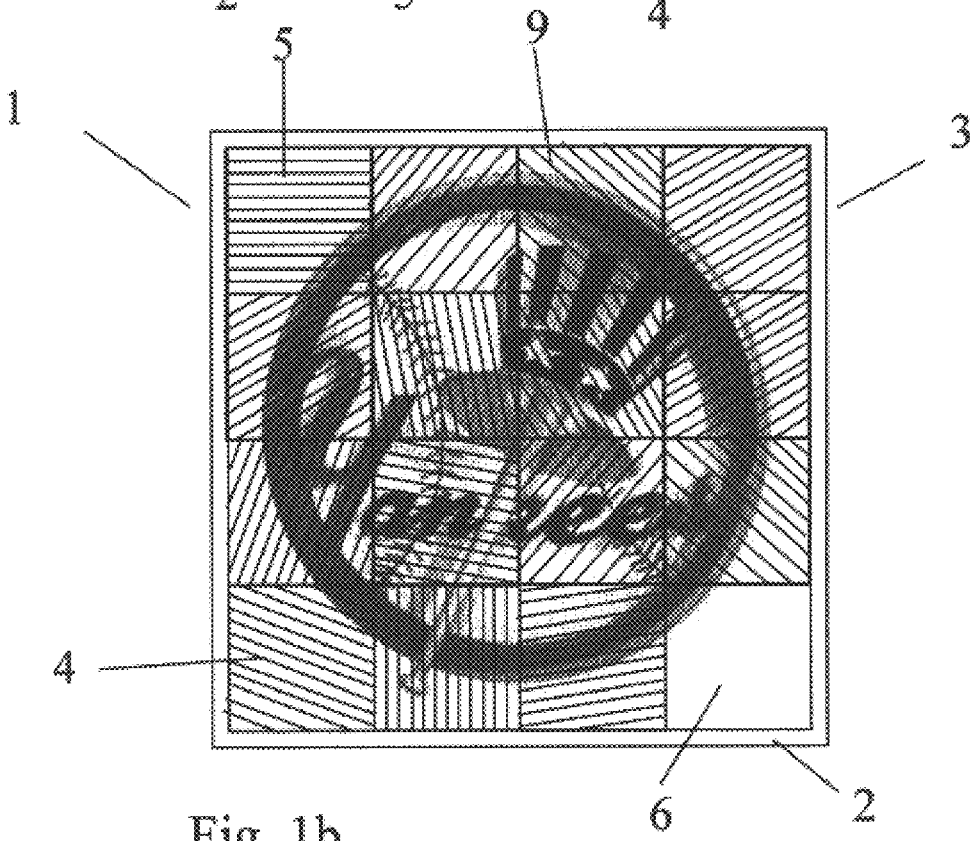
Fig. 1b

Fig. 2c
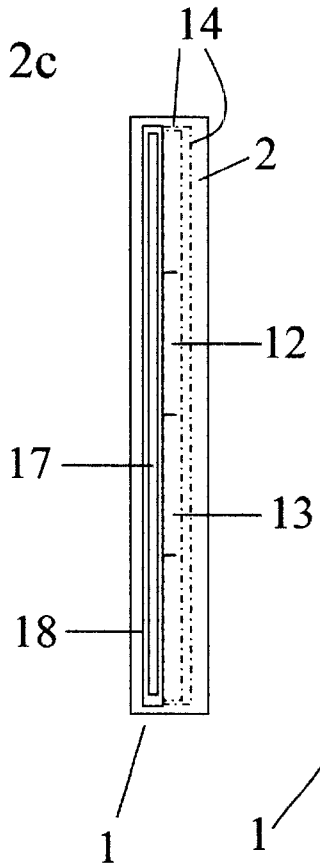
Fig. 2a
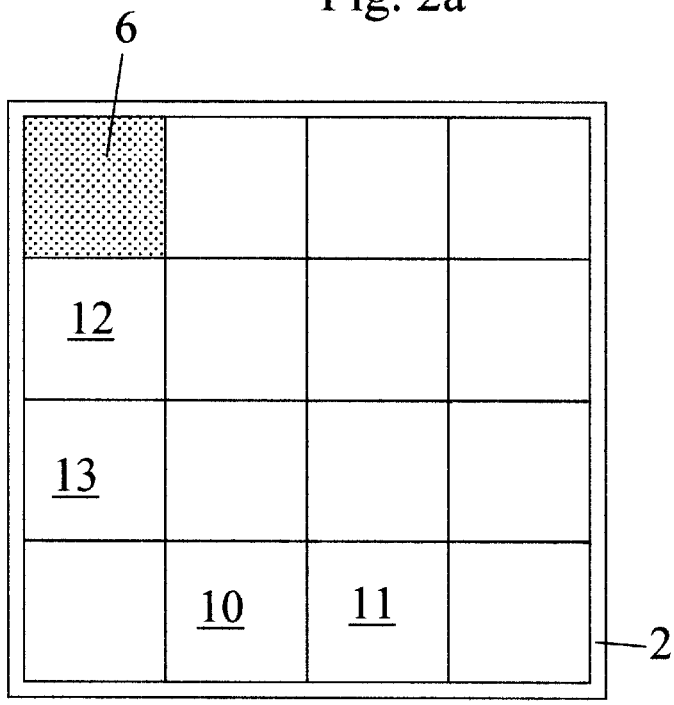
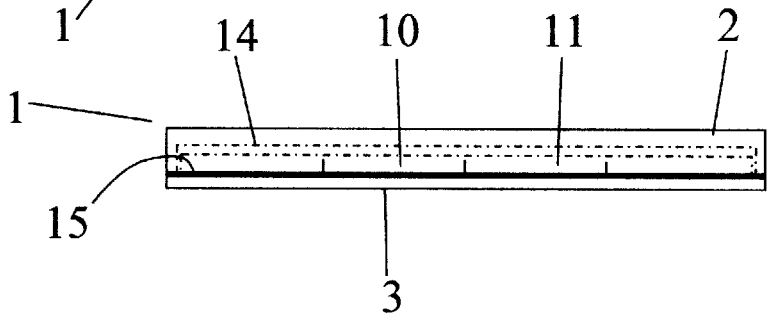
Fig. 2b

ENCODED IMAGE PUZZLE/DECODER

CROSS-REFERENCE TO EARLIER FILED APPLICATION

The present application claims the benefit of priority of earlier filed provisional U.S. patent application Ser. No. 60/088,138 which was filed on Jun. 5, 1998, the entire disclosure of which is hereby incorporated by reference.

FIELD OF THE INVENTION

The present invention relates generally to devices having encoded images and, more particularly, to a decoder for viewing images formed from encoded images. The invention also relates to slide puzzles comprising decoding lenses which superpose encoded images.

BACKGROUND OF THE INVENTION

Lenticular lenses affixed to respective substrates bearing respective lens-resolvable linear-patterned encoded images are commercially available. The lines from the patterned image must be in alignment with the lenticules of the lenticular lens in order to form a readily viewable resolved image. Known lenticular lens/patterned image-bearing substrate combinations have generally met this requirement by permanently affixing the substrate directly onto the back of the lenticular lens or by directly printing the patterned image onto the back of the lenticular lens.

Such substrates in combination with lenticular lenses are disclosed in U.S. Pat. Nos. 5,488,452 to Goggins, 5,568,313 to Steenblik et al., 5,543,964 to Taylor et al., 5,461,495 to Steenblik et al., 4,935,335 to Fotland, 4,082,433 to Appledorn et al., 3,937,565 to Alasia, 3,538,632 to Anderson, 3,119,195 to Braunhut While known lenticular lens-containing promotional items provide a user entertainment and provide some degree of interaction, they can be further improved by increasing the level of interaction such as by letting the user properly align the lenticules of the lenticular lens with the lines of a linear-patterned image of a puzzle.

Puzzles comprising a plurality of unencoded image-bearing pieces have been known for centuries. The pieces generally have unique shapes which can be assembled in a unique manner to form an assembled image. The puzzle pieces heretofore have always borne an image portion that was readily viewable and discernible.

Thumb puzzles, or slide puzzles, comprising plural unencoded image-bearing pieces assembled in a frame have been known for decades. Such puzzles have generally comprised plural slidable pieces each of which bears an unencoded readily viewable and discernible image portion. When the pieces are assembled in an appropriate manner, a coherent unencoded readily viewable and discernible image is formed. U.S. Pat. No. 5,769,418 to Gilbert et al. discloses a slide puzzle having a transparent first image plane superposing a second image plane. The first image plane comprises plural slidable transparent first tiles several or all of which bear sections of a first image. The second image plane comprises an image bearing sheet or plural slidable second tiles several or all of which bear sections of a second image.

Other slide puzzles shaped as cubes, planes, cylinders or polygonal structures are disclosed in U.S. Pat. No. 5,845,904, No. 5,470,065, No. 5,267,732, No. 5,116,053, No. 5,074,561, No. 4,949,969, No. 3,829,101, No. 5,529,301, No. 4,872,682, No. 4,269,414, No. 4,097,049, No. 5,060,948, No. 4,927,150 and No. 4,422,641. However, none of these prior art puzzles incorporate sliding pieces that are actually decoding lenses that decoding encoded images which they superpose.

Thus, to date, there has been no puzzle available for momentarily aligning plural decoding lenses with corresponding encoded image portions on a substrate to form an unencoded and preferably assembled image. It is an object of the invention to provide such a method and apparatus.

SUMMARY OF THE INVENTION

The present invention provides an encoded-image viewer and puzzle that can be used to view one or more of a variety of encoded images with one or more decoding lenses. The apparatus of the invention is simple to use, inexpensive to manufacture and can be used to view almost any lens resolvable or decodable image.

The present invention seeks to overcome the disadvantages known in the art of puzzles and encoded image viewers and to provide a puzzle or decoder for viewing encoded images whereby one or more decoding lenses are slidable or movable with respect to a substrate bearing an encoded image which comprises one or more encoded image portions. When a decoding lens is properly aligned with an encoded image portion on the substrate, a readily viewable decoded or unencoded image is formed.

In one aspect, the invention provides a puzzle or viewer for viewing and decoding an encoded image, said viewer comprising:

- a substrate bearing an encoded image on a first surface, wherein said encoded image comprises one or more encoded image portions;
- a body having opposing first and second surfaces and a receptacle for at least one of receiving and retaining said substrate;
- one or more decoding lenses superposed said substrate for decoding said one or more encoded image portions on said substrate; and
- a first retainer for retaining said one or more decoding lenses with said body.

One or many different lens-resolvable encoded images can be viewed with the viewer of the invention. A single encoded image or image portion can form one or more corresponding assembled images according to the pattern employed.

The retainer of the puzzle or viewer of the invention can be integral with or attached to the body and/or the decoding lenses. Various types of retainers as described herein are contemplated by the invention. The decoders and puzzles of the invention can also comprise one, two, three or more retainers.

The substrate used in the viewer or puzzle of the invention can be made permanent or semipermanent and can be replaceable or removable.

In some embodiments of the invention, the puzzle or viewer will comprise a bypass portion wherein one or more decoding lenses or puzzle pieces can be inserted. The bypass portion can be attached to or be integral with the body of the viewer or puzzle.

Another embodiment of the invention provides an encoded image puzzle decoder capable of forming a decoded image from a lens-resolvable encoded image disposed on a substrate, said puzzle decoder comprising:

- one or more decoding lenses each of which has a front and a rear surface;
- a substrate bearing on an upper surface a lens-resolvable encoded image comprising one or more lens-resolvable encoded image portions;

a body having a receptacle for at least one of receiving and retaining said substrate; and a retainer associated with at least one of said body and said one or more lenses for retaining said one or more lenses with said body;

wherein said one or more lenses superpose said receptacle and said upper surface of said substrate and each one of at least two of said one or more lenses decodes a different one of said plural lens-resolvable encoded image portions.

In another aspect, the invention is a substrate bearing plural lens-resolvable encoded image portions wherein each of at least two of said image portions is disposed such that either at least two different lenses or at least two different lens orientations are required to decode said each of at least two of said image portions.

The viewer of the present invention can also be used to simultaneously decode plural encoded images thereby forming plural decoded images. Thus, the invention also provides a hand-held viewer for simultaneously decoding plural encoded images comprising:

one or more decoding lenses each having a front and rear surface and a plurality of lenticules disposed on at least one of said surfaces; and plural substrates each having a front surface bearing an encoded image;

said one or more lenses superposing said front surfaces of said plural substrates, said front surfaces of said plural substrates being adjacent said rear surfaces of said one or more lenses, and each of said one or more lenses being alignable with at least one of said plural substrates to form plural decoded images.

Another embodiment of the invention provides a viewer for viewing and decoding an encoded image on a surface wherein said encoded image comprises one or more encoded image portions, said viewer comprising:

an encoded image comprising one or more encoded image portions;

a body having an interior surface defining an open or sealed cavity wherein said body has at least one viewing port through which said encoded image and contents of the cavity can be viewed; and one or more decoding lenses retained by and disposed within the cavity of said body;

wherein said one or more decoding lenses can superpose said encoded image thereby forming a decoded image.

The viewing port of the viewer or puzzle of the invention is intended to permit a user to view the contents of the puzzle. The viewing port can be made of a transparent or translucent material covering or being adjacent an opening in the body of the viewer. The viewing port can also comprise a decoding lens.

According to the particular construction employed for the viewer, it can be collapsible, rigid, semi-rigid or flexible. The viewer of the invention can also comprise one, two, three or more viewing ports and one, two, three or more decoding lenses.

Yet another embodiment of the invention provides a puzzle or viewer comprising:

a body having an exterior surface and an interior surface defining a cavity;

one or more substantially planar puzzle pieces disposed within said cavity and retained by said body wherein said one or more puzzle pieces can be assembled to solve said puzzle; and one or more viewing portions disposed on said body through which said one or more puzzle pieces are viewable.

It is not necessary that the decoding lens employed in the puzzle or viewer of the invention comprise more than one piece, although it can comprise more than one different decoding lens portion. A puzzle according to the invention can comprise one or more puzzle pieces which themselves independently comprise one or more decoding lenses, encoded images, unencoded images, holographic images, image-bearing members, disc-shaped members, hidden images and combinations thereof.

Also according to the construction employed, a puzzle according to the invention can have an encoded or unencoded image borne on a substrate within a cavity of the puzzle, a substrate external to the cavity of the puzzle, or on an interior surface of a cavity in the puzzle.

Still another embodiment of the invention provides a viewer for viewing an encoded image comprising:

a body having a first surface;

an encoded image comprising one or more encoded image portions superposing said first surface of said body;

at least one decoding lens superposing said encoded image; and a retainer for retaining said at least one decoding lens in slidable relation to and with said body.

The viewer of the invention can include a body which comprises one, two or more substantially cylindrical portions which are superposed by an encoded image and which encoded image is superposed by at least one decoding lens that can slide radially or longitudinally with respect to the cylindrical portion. When the body comprises two or more cylindrical portions, they will generally be coaxial and radially rotatable with respect to one another and generally have approximately the same circumference. As well the substantially cylindrical portion can be adapted to permit movement of one or more decoding lenses from one cylindrical portion to another cylindrical portion.

A decoder of the invention having cylindrical portions can also include a retainer comprising two or more radially spaced members or two or more longitudinally spaced members.

Some aspects of the invention include a combination decoding lens comprising two or more different decoding lenses independently selected from the group consisting of a lenticular, fresnel, color filtering, light filtering, diffusing, focusing, spheric, aspheric, and image altering lenses.

Another embodiment of the invention provides a puzzle comprising:

a substantially planar body;

plural image-bearing puzzle pieces disposed adjacent one another in a substantially planar arrangement, the pieces being slidable with respect to one another and said body and each piece having a first side adjacent the body and an opposing second side;

a retainer which keeps the puzzle pieces adjacent the body and in proximity to one another;

a first image comprising first image portions, said first image portions disposed on said opposing side of said puzzle pieces; and a second image comprising second image portions disposed on said first side of said plural puzzle pieces;

wherein said body has at least one viewing portion through which at least one of said first image portions can be viewed.

The viewing portion can comprise one or more decoding lenses and can be used to decode an encoded image on the first side of the puzzle pieces. The viewing portion can also comprise a translucent or transparent element which will permit viewing of a first unencoded image or encoded image on the puzzle pieces. The decoding lenses of the invention can comprise two, three or more different decoding lens portions.

Another embodiment of the invention provides a combination puzzle independently comprising two, three or more of any of the puzzles described herein. The two, three or more individual puzzles that comprise a combination puzzle can be disposed back to back, back to front, front to back, side to side, top to bottom and bottom to top. The two or more puzzles can be the same or different and they can be connected to form a three-dimensional object such as a cube, pyramid, rhombohedron, sphere, ellipsoid, hyperboloid, paraboloid, diamond, any geometric form and combinations thereof.

In another aspect, the invention is an improved slide puzzle comprising plural sliding pieces disposed within a retainer, the improvement comprising using at least one decoding lenses as a sliding piece and placing an encoded image or encoded image portion on a surface within the retainer such that a decoded image is formed when the decoding lens superposes the encoded image. In this aspect, the puzzle can be shaped substantially as any known slide puzzle, for example, as a plane, cube, sphere, pyramid, polyhedron, cylinder, or polygonal structure. One or more faces or surfaces of the puzzle will bear a sliding piece which is a decoding lens. Also, one or more faces or surfaces of the puzzle will bear an encoded image or encoded image portion which the decoding lens can superpose to form a decoded image.

Other features, advantages and embodiments of the invention will be apparent to those skilled in the art by the following description, accompanying examples and appended claims.

BRIEF DESCRIPTION OF THE DRAWINGS

The following drawings are part of the present specification and are included to further demonstrate certain aspects of the invention. The invention may be better understood by reference to one or more of these drawings in combination with the detailed description of the specific embodiments presented herein.

FIG. 1*a*. Top plan view of a first embodiment of the puzzle/decoder according to the invention having an encoded image comprising encoded image portions.

FIG. 1*b*. Top plan view of the puzzle/decoder of FIG. 1 wherein plural lenticular decoding lenses have been placed over corresponding plural encoded image sections thereby forming a decoded image.

FIG. 2*a*. Top plan view of the puzzle/decoder of FIG. 1 wherein the lens orientations, or lenticules of the lenticular lenses, the encoded image and decoded image portions are not depicted.

FIG. 2*b*. A front side elevation of the puzzle/decoder of FIG. 1.

FIG. 2*c*. A left side elevation of an alternate embodiment of the puzzle/decoder according to the invention depicting a removable substrate and a receptacle in the body for retaining or receiving the substrate.

DETAILED DESCRIPTION OF THE INVENTION

Figure 3A:
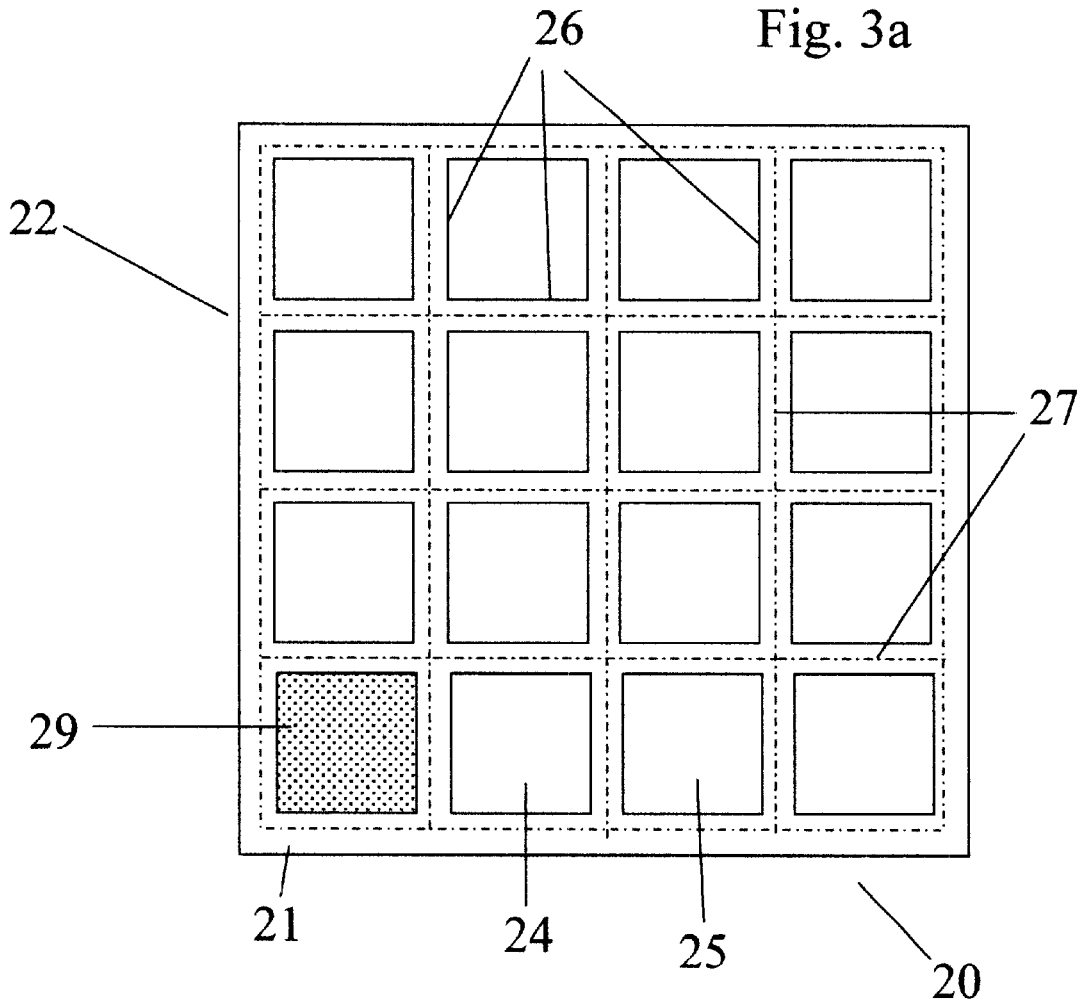
FIG. 3*a*. A top plan view of a second embodiment of the puzzle/decoder according to the invention depicting a frame-type retainer superposing plural decoding lenses for retaining the lenses with the decoder.

The encoded image puzzle decoder of the invention can be used to form readily viewable and/or decoded images from lens-resolvable encoded images. The simple design and construction of the present viewer is particularly advantageous and can be used to provide related promotional items and toys.

Referring now to FIG. 1*a,* the decoder/puzzle (1) comprises a body (2), plural decoding lenses (4, 5 and others unnumbered), and a substrate (3) disposed beneath the plural decoding lenses. The substrate has a first surface adjacent the plural decoding lenses that bears an encoded image comprising plural encoded image portions (7). The plural decoding lenses in FIG. 1*a* will form a decoded image (9) only when each lens superposes its corresponding encoded image portion (7) borne by the substrate (3). The decoder (1) comprises fifteen decoding lenses and a substrate (3) bearing sixteen image sections, fifteen of which are encoded and the sixteenth of which is decoded. In a decoder having a construction according to FIG. 1*a,* it will be necessary to have an open area (8) in order to permit movement of the remaining decoding lenses within the decoder. It will also be necessary that the open area (8) be at least as large as one of the plural decoding lenses. The decoding lenses are held in place by a retainer (not shown).

During operation one or more of the plural decoding lenses is slid along the surface of the substrate (3) while being retained within the body (2). As the decoding lenses are slid over the encoded image borne by the substrate (3), each lens will decode only that or those corresponding encoded image portions which it was designed or intended to decode. For example, as shown in FIG. 1*a,* decoding lens (4) is disposed at the bottom right of the decoder (1); however, since the decoding lens (4) was not designed to decode the encoded image portion disposed below it, a decoded image is not formed. Once the decoding lens (4) superposes the correct and its corresponding encoded image portion, it will form a decoded image. FIG. 1*b* depicts decoding lens (4) superposing its corresponding encoded image portion thereby forming a decoded image portion. In much the same manner, FIG. 1*a* depicts decoding lens (5) superposing an encoded image portion which it was not intended to decode; therefore, a decoded image portion is not formed. Referring again to FIG. 1*b,* decoding lens (5) is depicted superposing the encoded image portion which it was intended to decode, thereby forming a decoded image portion.

In substantially the manner as described for decoding lenses (4) and (5), the remaining thirteen lenses can be slid along the surface of the substrate while being retained within the body (2). Only after each lens superposes an encoded image portion which it was intended to decode will a full decoded image form. Thus, FIG. 1*b* depicts the decoder (1) having each of fifteen decoding lenses superposing its respective encoded image portion which it was intended to decode. The decoded image portions can form an assembled decoded image or each decoded image portion can be independent of the other decoded image portions. It is only necessary that each decoding lens can superpose an encoded image portion which it was intended to decode. Once all of the decoding lenses have been correctly positioned, the remaining space which was (8) in FIG. 1*a* is now (6) in FIG. 1*b;* however, the design of the puzzle can be such that the open area or space (6) can be disposed anywhere within the puzzle. The encoded image, the decoded image and the orientation of the lenses of the decoder (1) have not been indicated.

The decoder (1) comprises a body (2) which is a frame. The plural decoding lenses are disposed within the body (2) and are in a slidable relation to both the body (2) and the substrate (3). The plural decoding lenses are retained with the body by a retainer which can be any retaining means that will maintain the plural decoding lenses with the body. Referring now to FIG. 2*b,* the decoder (1) comprises the substrate (3) directly attached to the bottom surface of the body (2). The upper surface (15) of the substrate (1) bears the encoded image, and the plural decoding lenses (10, 11) superpose the upper surface (15). The plural decoding lenses are retained within the body (2) by a shoulder (14) which superposes the outer edges of the plural decoding lenses. In order to retain the centrally disposed plural decoding lenses of the puzzle (1) with the frame (2), the depicted embodiment will require a second retainer, for example, a tongue-and-groove mechanism, which can be integral with or attachable to one or more and preferably each of the plural decoding lenses and, optionally, to the body.

While the substrate (3) of the decoder (1) in FIG. 2*b* is depicted as being attached to the body (2), the substrate (3) can be removable from the decoder. Various methods known to those of ordinary skill in the art can be employed for making the substrate (3) permanently, semipermanently or temporarily attached to or retained by the body (2) of the decoder (1). One exemplary embodiment of a removable substrate is depicted in FIG. 2*c* wherein decoder (1) has a receptacle (18) containing a removable substrate (17). The receptacle (18) is defined by surfaces and edges which comprise the body (2). In preferred embodiments, a transparent member will separate the plural decoding lenses from the removable substrate (17) in order to maintain the plural decoding lenses with the frame (2) while removing the substrate (17).

Figure 3B:
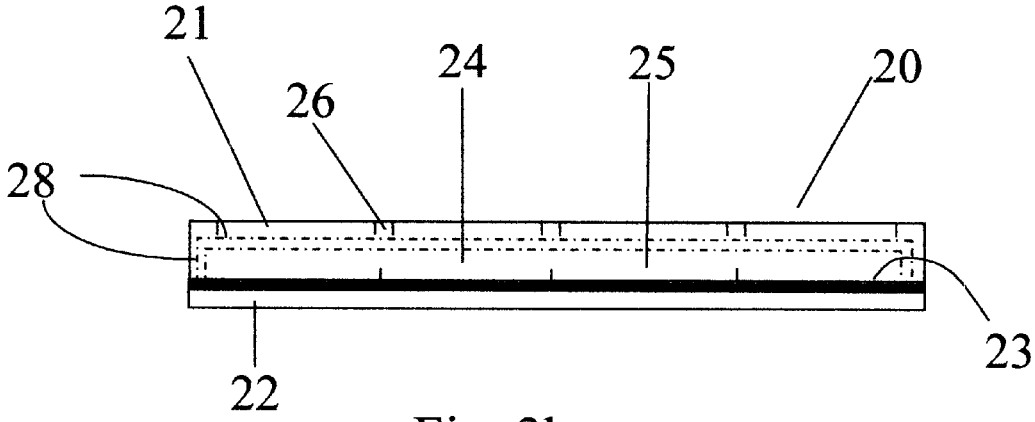
FIG. 3*b*. A front side elevation of the puzzle/decoder of FIG. 3*a*.

Although the embodiment of the decoder (1) depicted in FIGS. 1*a* through 2*b* may require more than one retainer, the decoder (20) depicted in FIG. 3*b* will require only one type of retainer to maintain the plural decoding lenses with the body (21). The retainer (26) can be either integral with or attached to the body (21). Retainer portions (27) superpose the edges of respective underlying decoding lenses (24, 25 and other unnumbered) as depicted by the lines in phantom (27). The decoding lens (24, 25 and others unnumbered) are slidable with respect to the substrate (22) and the body (21) while being retained by the retainer (26). In this embodiment, the plural decoding lenses will not completely cover the substrate (22) since the space (29) will be required to permit the plural decoding lenses to be slid within the body. As in the embodiments depicted in FIGS. 1*a* through 2*b,* the substrate (22) can be permanently, semipermanently or temporarily attached to or retained by the decoder (20). The substrate (22) can bear the encoded image on a first surface (23) which is adjacent a lower surface of the plural decoding lenses.

Figure 4:
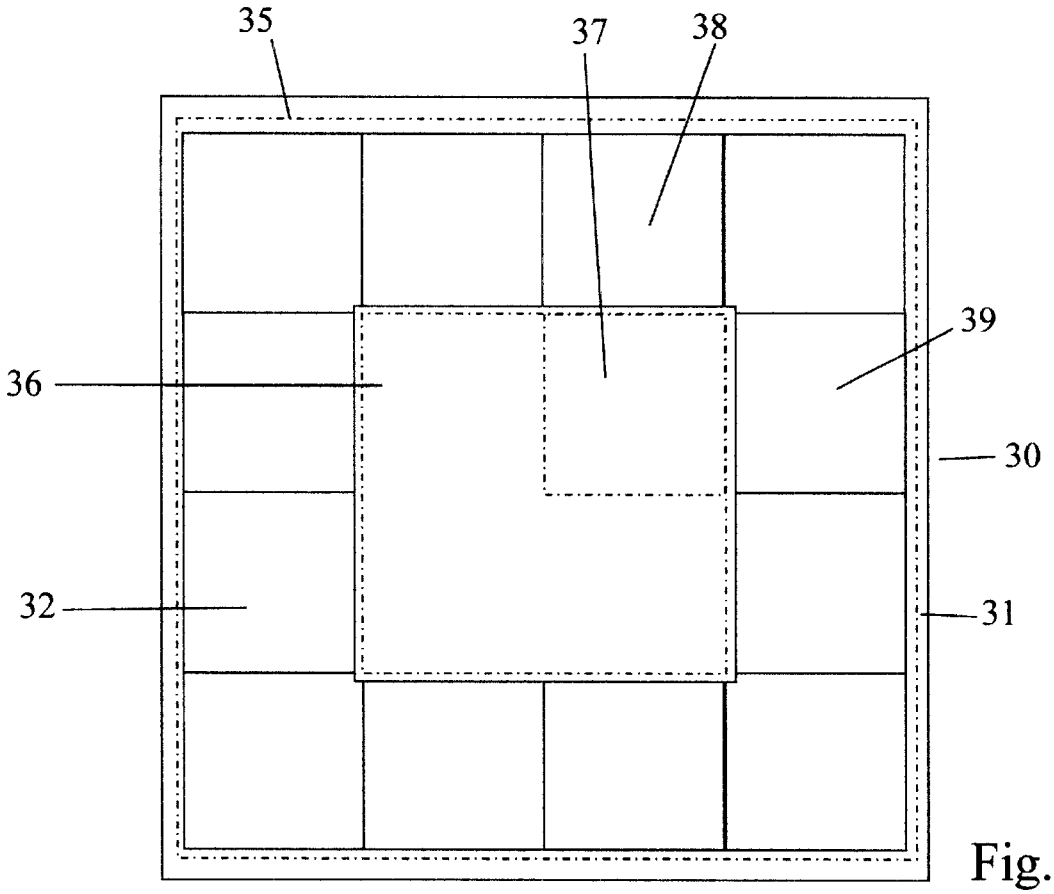
FIG. 4. A top plan view of a third embodiment of the puzzle/decoder of the invention depicting plural lenses retained with the decoder by two different types of retainers.

FIG. 4 depicts a third embodiment of the puzzle/decoder according to the invention. The decoder (30) comprises a body (31) and a substrate (not shown). Plural decoding lenses (32) superpose the substrate and are retained with the body (31) by the retainer which comprises a first retaining means (35) and a second retaining means (36). The retainer (35, 36) can employ mechanisms such as a tongue-and-groove mechanism to retain the plural decoding lenses with the body. It can also superpose the edges of the plural decoding lenses (32) thereby maintaining the lenses adjacent the body (31). The retaining means (36) comprises a plate directly attached to the body (31); however, a portion on the under side of the plate (36) is not attached to the body (31), and with the body (31), the portion defines an open area (37) which serves as a bypass for plural decoding lenses to be slid into and out of. For example, the plural decoding lenses (32) of the decoder (30) superpose all visible portions of the substrate (not shown). Absent the bypass (37), the plural decoding lenses could not move within the frame by sliding; however, with the bypass (37), the plural decoding lenses can be slid within the body (31) while being retained by the retainer. The decoding lens (38) can be slid into the bypass space (37) thereby permitting adjacent lenses to be slid where decoding lens (38) had been. In much the same manner and in an alternate embodiment, the bypass (37) will also receive a decoding lens (39).

Figure 5:
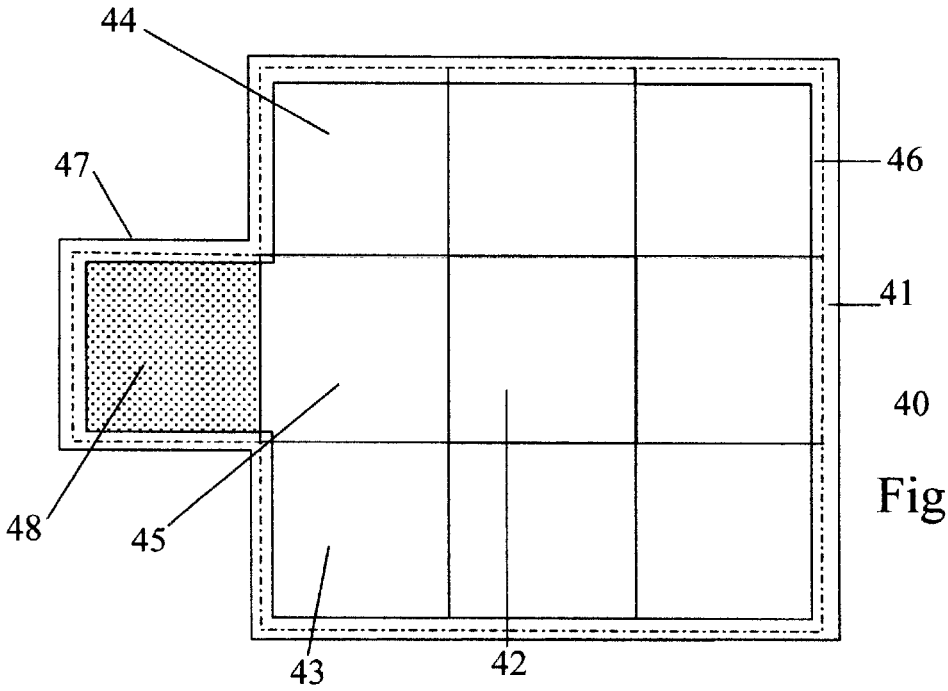
FIG. 5. A top plan view of a fourth embodiment of the puzzle/decoder according to the invention depicting a bypass attached to the body of the decoder for momentarily receiving and/or retaining a decoding lens.

FIG. 5 depicts a fourth embodiment of the puzzle/decoder of the invention. Decoder (40) comprises a body (41), plural decoding lenses (42), a substrate (not shown) and a retainer (46). In the alternate and exemplary embodiment depicted in FIG. 5, the decoder (40) comprises a bypass (48) which is formed as an extension (47) of the body (41). The bypass (48) will receive a decoding lens (45) thereby permitting other decoding lenses to be slid over the substrate to be placed over their respective encoded image portions which they are intended to decode.

Figure 8:
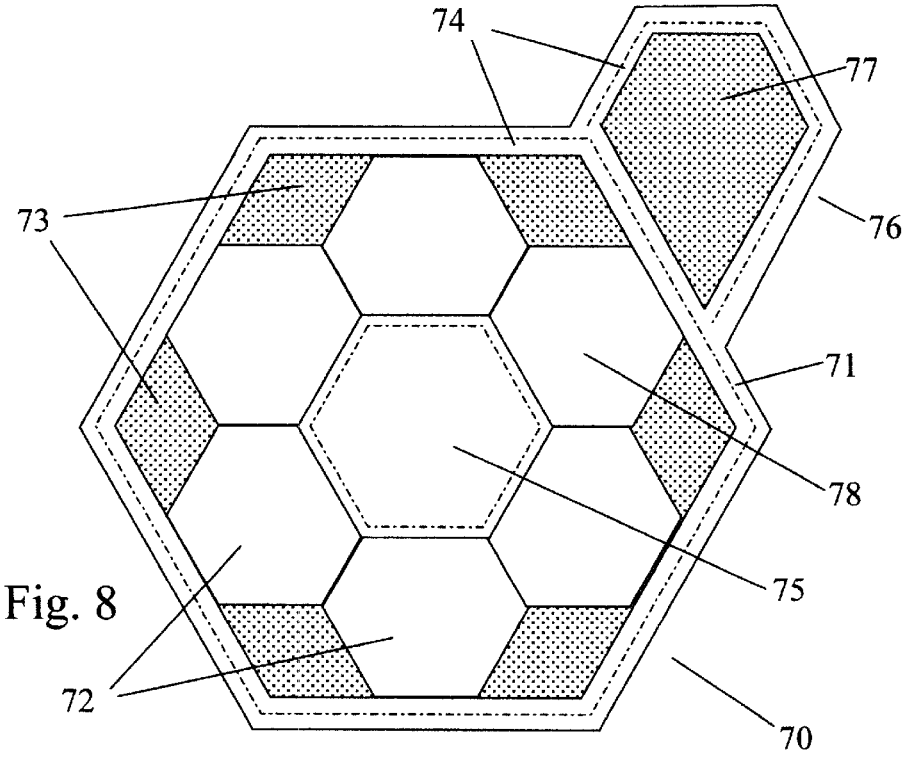
FIG. 8. Top plan view of a seventh embodiment of the puzzle/decoder according to the invention depicting a hexagonal shaped body containing similarly shaped decoding lenses and a bypass section attached to the body for receiving at least one of said decoding lenses.

FIG. 8 depicts another exemplary embodiment of the puzzle/decoder. The decoder (70) is hexagonally shaped and has a bypass (77) formed as an extension (76) of the body (71). The retainer comprises retaining means (74) and (75). The substrate (73) is visible from above and has portions that are not superposed by the decoding lenses (72) of the invention. The hexagonally shaped plural decoding lenses (72) are retained with the body (71) by retaining means (74) and (75) and are slidable with respect to the body (71) and the substrate (73) only after the decoding lens (78) has been slid into the bypass (77). During operation, a decoding lens (78) is slid into the bypass portion (77) and the other remaining decoding lenses (72) are slid within the decoder puzzle in a circular fashion around the retaining member (75) in either a forward or reverse direction. The decoding lens (78) can then be inserted into the main part of the body (71) thereby permitting repositioning of the plural decoding lenses. The substrate (73) bears at least one encoded image portion which is disposed below one or more of the decoding lenses (72). When a decoding lens (72) superposes an encoded image which it was designed to decode, an unencoded image will be formed and will be visible through the decoding lens (72).

Figure 6:
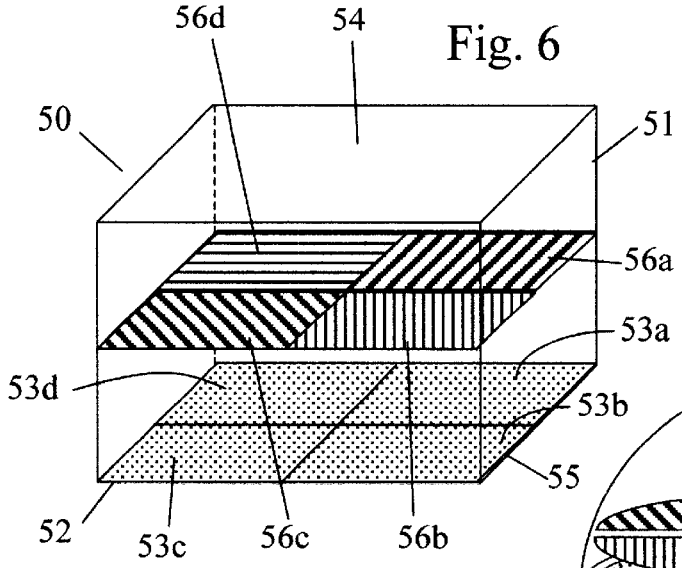
FIG. 6. A perspective view of a fifth embodiment of the puzzle/decoder according to the invention depicting a retaining cover attached to an encoded image-bearing substrate thereby defining a cavity containing plural decoding lenses.

While the previously mentioned embodiments of the decoder according to the invention permit a user to directly contact the decoding lenses, it is not necessary that such direct contact occur in order for the decoder puzzle to operate as intended. FIG. 6 depicts a decoder (50) which comprises a body (51) having attached thereto at one end a cover (54) and at an opposite second end (55) a substrate (52) wherein the three together define an interior cavity containing plural decoding lenses (56*a*–56*d*). A substrate (52) bears on a first surface (55) plural encoded image portions (53*a*–53*d*) which encoded image portions are decodable by the respective decoding lenses (56*a*–56*d*). The decoding lenses (56*a*–56*d*) are depicted as having different lenticular orientations, thus requiring that each lens to assume a particular orientation with respect to the substrate in order to decode respective encoded image portions (53*a*–53*d*). For example, if the decoding lens (56*a*) superposes the encoded image portion (53*b*), a decoded image will not be formed since the decoding lens (56*a*) was not intended to decode that image portion. However, when the decoding lens (56*a*) superposes the encoded image portion (53*a*), a decoded image is formed. The cover (54) can be either attached to or integral with the body (51). Together the cover (54) and the body (51) form a retainer. Thus, the decoder (50) comprises a retainer having attached thereto a substrate bearing encoded image portions (53*a*–53*d*), the two together defining a cavity containing plural decoding lenses (56*a*–56*d*).

Although the decoder (50) includes plural decoding lenses (56*a*–56*d*) each having a unique lenticular orientation and requiring a particular superposition of the lens on respective encoded image portions. The decoder (50) can comprise plural decoding lenses that are either all similar, are of at least two different types or orientations, or more preferably comprise three or more different types or orientations. The plural decoding lenses (56*a*–56*d*) can move freely within the cavity defined by the retainer and the substrate (52). However, the decoder (50) can be designed so that the lenses (56*a*–56*d*) can have restricted motion within the cavity such as by changing the body (51) height, width or length. For example, if the body, and thus cavity, height is reduced to a height that is shorter than the length and width of the individual decoding lenses (56*a*–56*d*), then said lenses will only be able to rotate and slide about within the cavity, but they will not be able to flip upside down within the cavity. Correspondingly, if the height of the retainer is made greater than the length or width of the individual decoding lenses (56*a*–56*d*), then the lenses will be able to rotate, slide, flip and move freely within the cavity.

Figure 7:
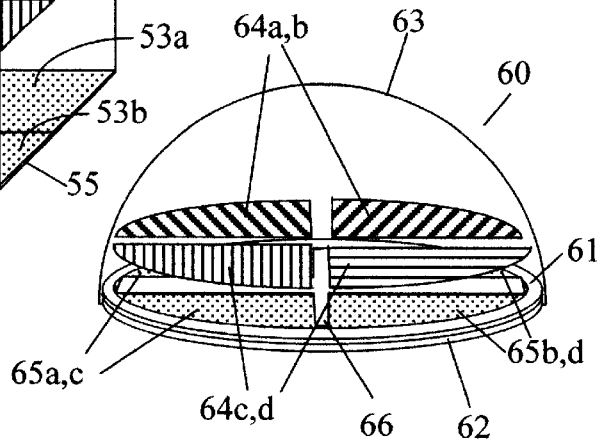
FIG. 7. Perspective view of a sixth embodiment of the puzzle/decoder according to the invention depicting a retaining cover attached to a body having an encoded image thereby defining a cavity containing plural decoding lenses.

FIG. 7 depicts an alternate embodiment of the decoder of FIG. 6. The puzzle/decoder (60) comprises a retainer (63) attached to a body (61) which superposes a substrate (62). The body (61) can comprise dividers (66) which form individual sections through which are visible plural encoded image portions (65*a*–65*d*) borne by the substrate (62). Together the retainer (63), the body (61) and the substrate (62) define a cavity within which are disposed plural decoding lenses (64*a*–64*d*). While the decoder (60) comprises the retainer (63) and the body (61) as separate elements, the decoder of the invention can comprise a retainer and a body as an integral single element. For example, in another embodiment of the invention, the decoder comprises a retainer attached to a substrate bearing plural encoded image portions wherein the retainer and the substrate together define a cavity within which are disposed plural decoding lenses for decoding the encoded image portions.

The cover (63) can be shaped as desired and can comprise dimensions which are either larger or smaller than the corresponding substrate (62) or body (61) to which the cover is attached. It is only necessary that the cover (63) comprise a viewing portion which is substantially transparent or translucent, thereby allowing a user to view the internal decoding lenses and the encoded image from the exterior of the puzzle.

Figure 9:
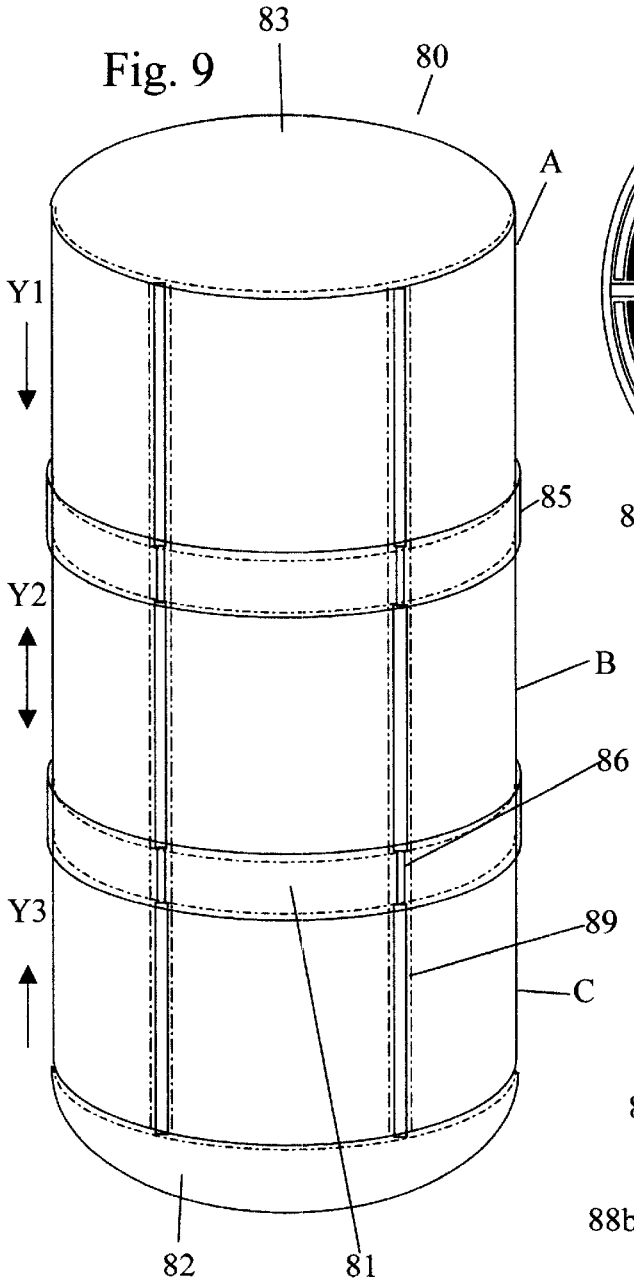
FIG. 9. A perspective view of an eighth embodiment of the puzzle/decoder according to the invention depicting a cylindrically shaped decoder having longitudinally adjacent rotatable sections, a retainer and decoding lenses that are radially and/or longitudinally slidable.

FIG. 9 depicts an eighth embodiment of the puzzle/decoder according to the invention. The decoder (80) comprises one, two, three or more substantially cylindrically-shaped, coaxial and longitudinally adjacent sections A, B and C which rotate about a cylindrically shaped body (81). Plural lenses (84) are disposed external to the body and are in slidable relation with the body (81). In one embodiment, the plural lenses (84) will slide from section (A) to section (B) as indicated by arrow (Y1), from section (B) to either section (A) or section (C) as indicated by arrow (Y2) or from section (C) to section (B) as indicated by arrow (Y3). Since the sections (A, B and C) are coaxial, rotatable about the axis of the cylindrically shaped body (81), and have approximately the same circumference, the plural lenses (84) can be slid and moved about as desired along the outer surface of the body (81). Interposed the body (81) and the plural lenses (84) is an encoded image (87) which can comprise one or more encoded image portions and can be borne on a substrate.

Although not depicted in FIG. 9, the decoder (80) comprises plural encoded image portions which are preferably but not necessarily stationary with respect to the surface of the body (81). External to the plural lenses (84) is the retainer (85) which superposes adjacent edges of the respective plural lenses (84), thereby retaining the lenses and maintaining the lenses adjacent the substrate (87).

Although the puzzle/decoder (80) comprises one or more longitudinally-spaced radial retainers (85) that each substantially surround a portion of the body (81), the decoder (80) can comprise one or more radially-spaced longitudinal retainers, as indicated by the phantom lines (89) that extend along the axis of the body (81). The decoder (80) can also comprise both one or more radially-spaced longitudinal retainers (89) and one or more longitudinally-spaced radial retainers (85). The retainers (85) or (89) can be attached to the body (81) through connecting members (86). The adjacent connecting members (86) define spaces through which individual decoding lenses (84) can slide. The retaining member (85), the support members (86) and the substrate (87) together also define a space through which the plural decoding lenses can pass or slide. The decoder (80) can also comprise opposing end portions (82) and (83) which are attached to the body (81) at opposite ends, thereby assisting in retaining the plural lenses (84) with the body (81). As with the other embodiments of the invention, a decoded image will be formed only when a decoding lens (84) superposes an encoded image which that decoding lens was intended to decode.

Figure 10:
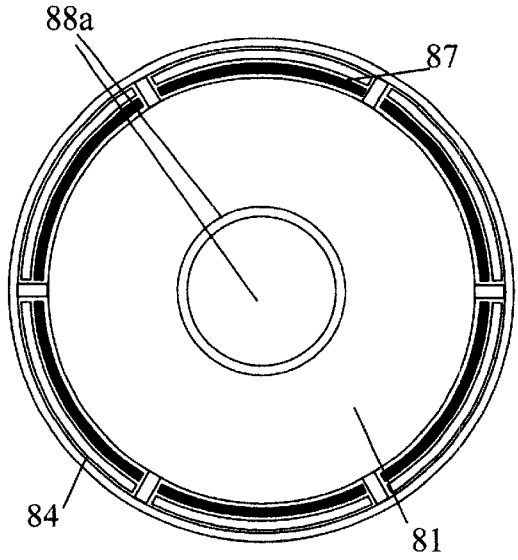
FIG. 10. A sectional view of rotatable Section A of the puzzle/decoder of FIG. 9.
Figure 11:
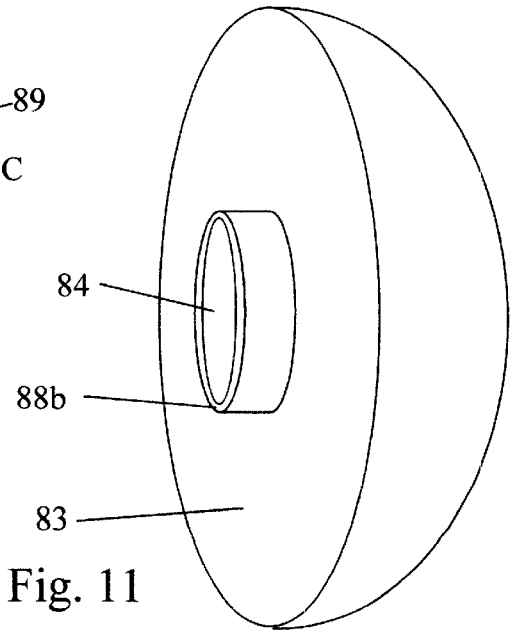
FIG. 11. A perspective view of an end attachment which comprises a portion of the body of the decoder of FIG. 9.
Figure 12A:
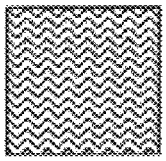
FIGS. 12*a* through 12*m*. Various exemplary embodiments of the decoding lens according to the invention.
Figure 12B:
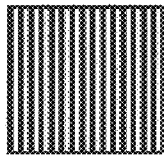
Figure 12C:
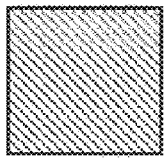
Figure 12D:
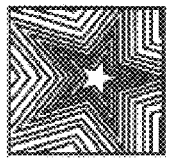
Figure 12E:
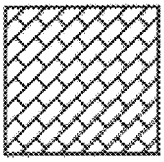
Figure 12F:
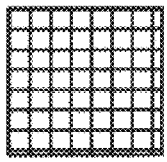
Figure 12G:
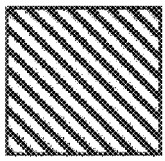
Figure 12H:
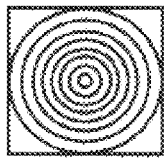
Figure 12I:
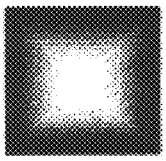
Figure 12K:
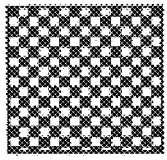
Figure 12J:
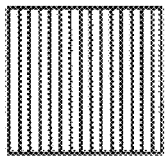
Figure 12L:
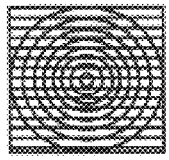
Figure 12M:
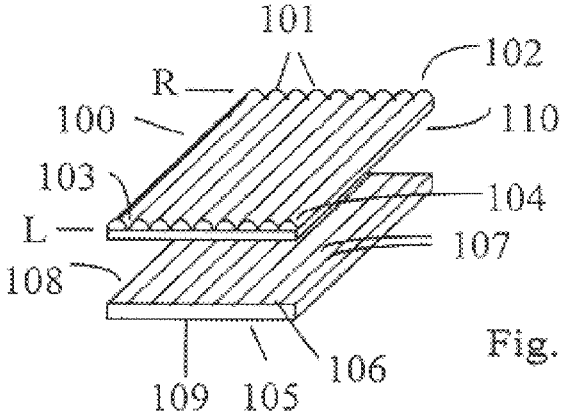

FIG. 10 depicts a sectional view of the rotatable section (A) of the puzzle/decoder (80) depicted in FIG. 9. The body (81) further comprises the connector **(88*a*) to which can be attached the end member (83). Referring now to FIG. 11, the end member (83) has a connector (88*b*) which mates with connector (88*a*) of the body (81) thereby attaching the end member (83) to the body (81). The connectors (88*a*) and (88*b*) can comprise essentially any connection means known to those of ordinary skill in the art such as a pressure fitting, threaded joint, snap-together joint, threaded slot, adhesive, and combinations thereof. The decoder (80) can also comprise a centrally disposed longitudinal rod to aid in keeping the various parts of the decoder assembled. Conversely, the individual sections (A), (B) and (C) and the ends (82) and (83)** can be interchangeable, replaceable and can snap together as desired.

Referring now to FIG. **12*m*, the decoding lens of the invention can comprise a lenticular lens. In an exemplary embodiment, the lens (100) comprises a plurality of closely spaced or adjacent, substantially equally sized, parallel, linear lenticules (101) disposed on the front surface (102). The spacing, or the nodes (103), between the lenticules (101) is minimal, and each lenticule has an apex (104). The substrate (105) comprises a lenticular lens-resolvable linear-patterned encoded image (the encoded image not shown) which itself comprises a plurality of image-bearing linear encoded image sections (106) and nulls (107) together forming the encoded image. The linear-patterned encoded imaged is disposed on the front surface (108) of the substrate (105) adjacent the rear surface (110) of the lens (100). The substrate (105) is separable from the lens (100). When the apexes (104) and the nodes (103) of the lens (100) are aligned with the image sections (106) and the nulls (107)** of the substrate, a decoded image is formed.

Such lenticular lenses are commercially available and can be made of plastic, rubber, polymer, glass, silicates or combinations thereof. A suitable lenticular lens will be light transmissive, transparent, translucent or semi-transparent. Such lenses can also be made flexible or rigid. Although the lenticules as depicted in the attached figures have a conical profile, they can also have a semicircular, square, blocked, rectangular, triangular or other equivalent profile. The profile can resemble any shape or combination thereof which will operate according to the invention.

Although the decoding lenses depicted in the attached figures can include substantially uniformly-sized and straight lenticules, the lenticules need not be uniform in size or straight. The lenticules can have different heights, width and curvatures. The lenticules can also be shaped as pyramids, stars, circles, ovals, triangles, squares, hemispheres, rectangles or other geometric, regular, irregular, symmetric or asymmetric shapes. FIGS. **12*a*–12*l*** depict exemplary non-limiting embodiments of the decoding lens. It is only required that the construction of the lens be such that the lens can align correctly with the corresponding linear-patterned image on a substrate and form an assembled image therefrom.

The decoding lenses of the invention are readily commercially available and comprise all such lenses that can filter out color from an image, add color to an image, distort an image, filter out light, permit passage of selected light waves, selectively view portions of and/or form an assembled image of spaced-apart image portions of an image. These lenses include fresnel, colored, color filtering, light filtering, lenticular, spheric, aspheric, paraboloid, hyperboloid, concave-convex, concave-concave, convex-convex, grating, diffracting, refracting, prismatic, diffusing, focusing, magnifying, reducing lenses and combinations thereof. Decoding lenses that are particularly suitable for the present invention are disclosed in U.S. Pat. No. 5,461,495 to Steenblik et al., U.S. Pat. No. 4,082,433 to Appeldorn et al., U.S. Pat. No. 3,937,565 to Alasia, U.S. Pat. No. 3,119,195 to Braunhut, U.S. Pat. No. 2,514,814 to Towne, U.S. Pat. No. 3,538,632 to Anderson, U.S. Pat. No. 5,543,964 to Taylor et al., U.S. Pat. No. 4,935,335 to Fotland, U.S. Pat. No. 5,568,313 to Steenblik et al., U.S. Pat. No. 5,206,761 to Ogino, U.S. Pat. No. 4,597,634, U.S. Pat. No. 4,717,239 and U.S. Pat. No. 5,002,364, the disclosures of which are hereby incorporated in their entirety by reference.

The decoding lenses of the invention can be stacked or otherwise arranged to individually, additively, synergistically, or cooperatively decode an encoded image or encoded image portion. For example, a color filtering lens can be combined, either by attachment or by being made integral therewith, with a lenticular lens to both filter out a color from and decode the linear pattern in an encoded image disposed beneath the combination lens. The present invention includes lenses having simple and complex construction such as lenses having a single optic layer or single decoding layer as well as combination decoding lenses comprising plural individual decoding lenses that have been attached or otherwise stacked.

A decoder according to the invention will comprise plural decoding lenses which shape can be independently selected at each occurrence from any known shape. In particular embodiments the shape of the plural decoding lenses will independently be selected from square, triangle, rectangle, parallelogram, hexagon, pentagon, heptagon, octagon, multi-sided polygon, multi-pointed star, geometric form with rounded corners, oval, elipse, regular, irregular, symmetric, asymmetric, and combinations thereof.

Although not required by the invention, the decoding lenses of the invention will preferably be substantially planar although they can be flat, arched or curved. The decoding lenses can also include indicia such as graphics, markings or text on either a front or rear surface thereof or within the lens itself (see FIG. 15*e*). The graphics, markings and text included with such a lens can cooperate with the decoded image formed by the lens to form yet another image. For example, if eyes are printed on the lower surface of a decoding lens and the decoding lens forms a decoded partial facial image, the decoded facial image together with the eyes on the bottom surface of the decoding lens will together form a full facial image. In this manner, decoded images can be combined with unencoded images to form yet more images. FIGS. 15*a*–15*g* depict exemplary shapes for the decoding lens of the invention.

Figure 13A:
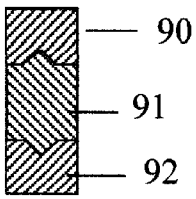
FIG. 13*a*. Sectional side view of a two-component decoding lens according to the invention.
Figure 13B:
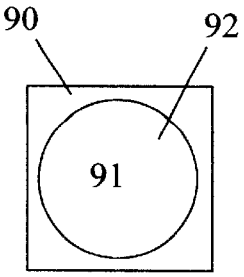
FIG. 13*b*. Top plan view of the decoding lens of FIG. 13*a*.

Referring now to FIG. 13, the lenticular lens (90) comprises two portions, an inner core (91) and an outer member (92) substantially completely surrounding the inner core (91). The inner core is itself a lens that is rotatable within the outer member (92). The outer member (92) can be shaped as desired and can be a lens.

Figure 16:
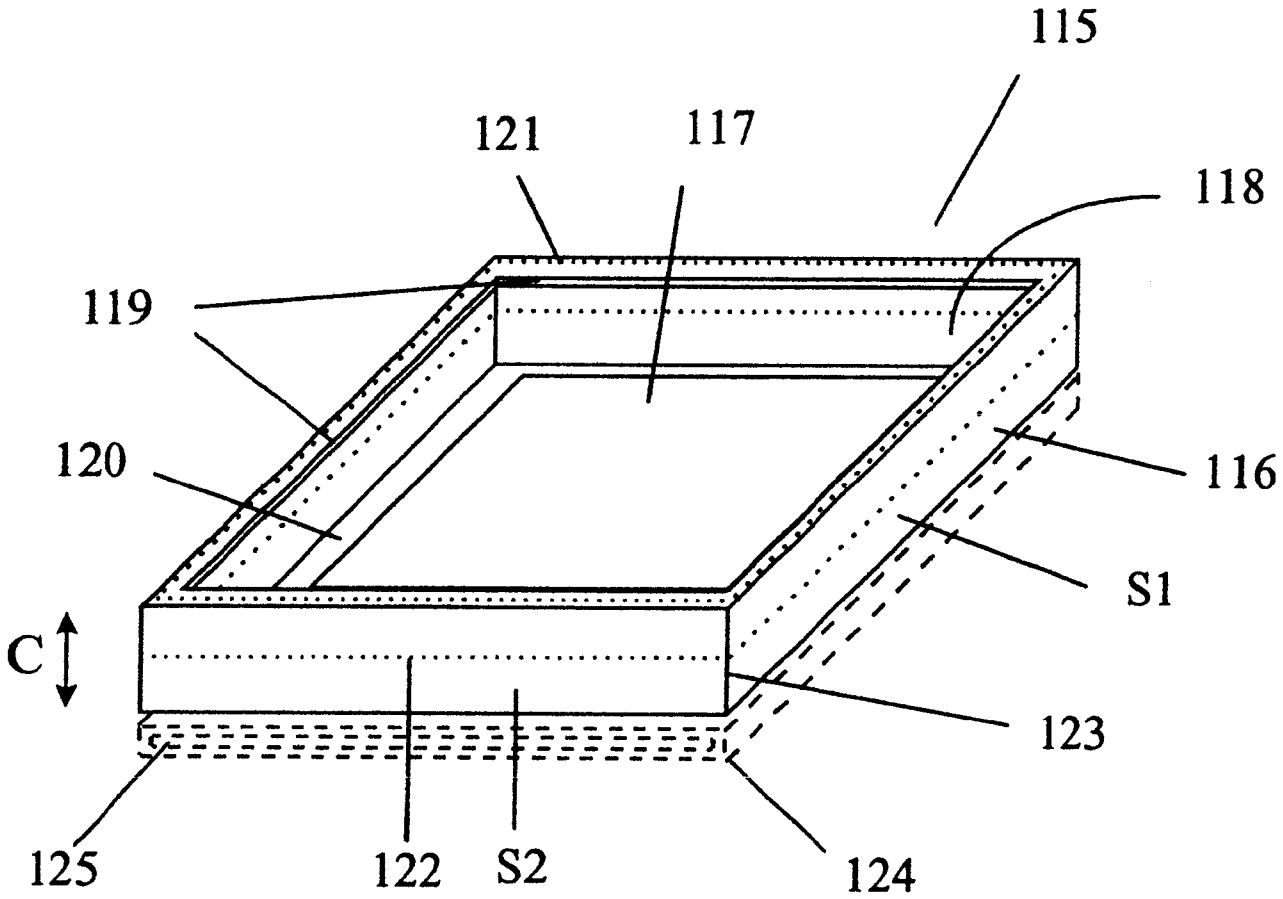
FIG. 16. Perspective view of a ninth embodiment of the puzzle/decoder according to the invention wherein the body is collapsible and can include one or more viewing portions.

While various of the embodiments of the puzzle/decoder and viewer of the invention have required a substrate bearing an encoded image, the present invention also provides decoders and viewers wherein the encoded image can be disposed on a variety of different elements of the decoder and viewer. FIG. 16 depicts a puzzle/viewer according to the invention. The puzzle (115) has a versatile construction that permits the preparation of puzzle with features including an externally mounted substrate, an internally mounted substrate, an encoded image borne on an inner surface of a body, a viewing port which can serve as a decoding lens, a collapsible body, and others.

The puzzle (115) comprises a body (116), an element (117), and a viewing port (118) which, in this exemplary embodiment, comprises the edges (119) which define an opening in the body (116) and a translucent or transparent element (121) (indicated in phantom) that covers the opening defined by the edges (119). The viewing port can be made from a material such as a transparent plastic, translucent plastic or rubber film, a screen, or it can be a decoding lens. Together the viewing port and the body will define a cavity containing one or more puzzle pieces (not shown). In one embodiment, the puzzle (115) comprises a receiving area (124) for receiving and/or retaining a substrate bearing an image. The receiving area (124) can comprise a receptacle (125) to facilitate replacement of the substrate. In another embodiment, the puzzle (115) comprises the element (117), which is an image, borne on an interior surface (120) of the body (116). The element (117) is viewable from the viewing port (118). When the element (117) is an encoded image, the puzzle (115) will contain within it one or more decoding lenses which can decode at least a portion of the encoded image (117).

When the puzzle (115) comprises an external substrate bearing an image to be viewed, the element (117) will be a second viewing port which has either the same or different construction as the viewing port (118). Such a puzzle would then comprise a body (116), a first viewing port (118), a second viewing port (117), one or more puzzle pieces disposed within the puzzle, and an external substrate bearing an image to be viewed, wherein the image is viewable through both of the viewing ports.

Figure 17A:
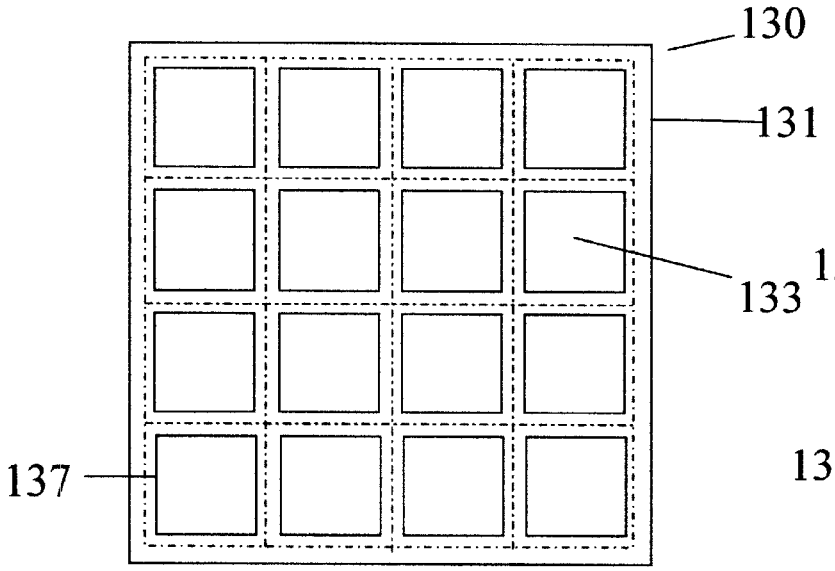
FIG. 17*a*. Top plan view of a tenth embodiment of the puzzle/decoder according to the invention.
Figure 17C:
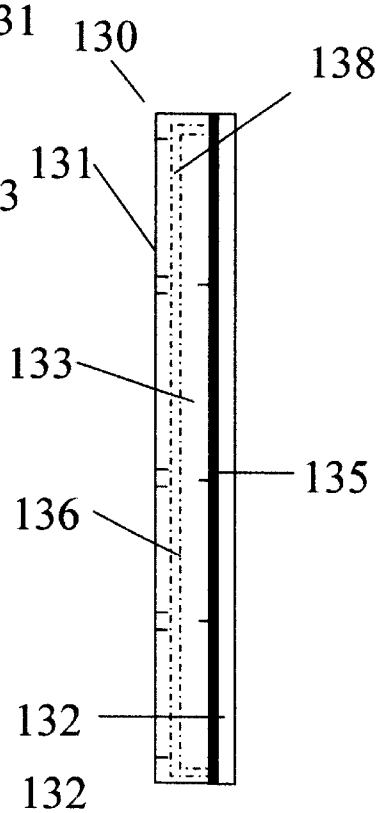
FIG. 17*c*. Side elevation of the puzzle of FIG. 17*a* and FIG. 17*b*.
Figure 17B:
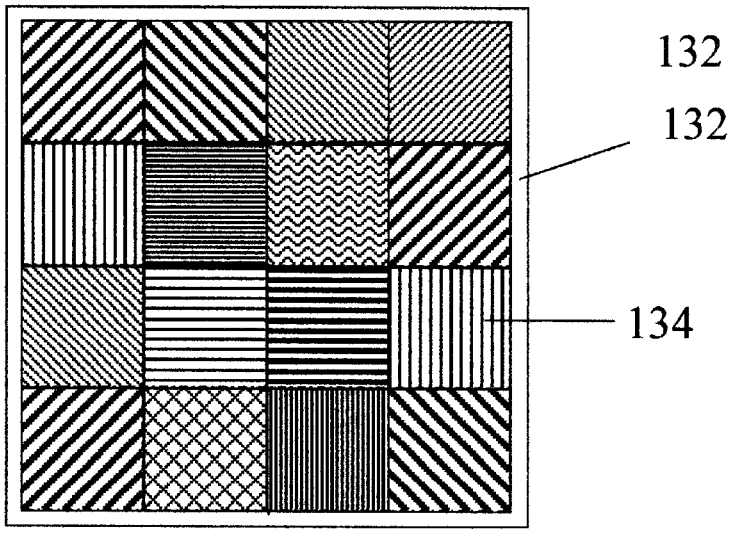
FIG. 17*b*. A bottom plan view of the puzzle of FIG. 17*a*.

Embodiments of the puzzle/decoder and viewer of the invention described thus far have included plural decoding lenses that are retained with the body by a retainer or retaining means. Each of these lenses has been a separate element. However, the decoder and viewer (130) depicted in FIGS. 17*a* through 17*c* comprises a retainer (131) affixed to a decoding lens (132), which decoding lens comprises one or more decoding lens portions (134). The decoding lens (132) together with the retainer (131) define a cavity (138) which can be opened or sealed. The retainer (131) can comprise one or more edges (137) defining one or more holes through the retainer (131) thereby permitting access to the cavity (138) and contents therein. The cavity (138) can contain therein one or more substrates (133) bearing images (not shown). Each substrate (133) can independently bear 0, 1 or more images on each of its two opposing surfaces (135) and (136). The holes in the retainer (131) formed by the edges (137) permit a user of the decoder and viewer (130) to contact the substrates (133). The decoding lens (132) comprises one or more decoding lens portions (134) which can be connected to one another or be integral with each other or combinations thereof to form the decoding lens (132).

Without being held to a particular mechanism, the puzzle/decoder and viewer (130) can be constructed and operated as follows. The decoder (130) can comprise plural substrates (133) bearing a readily viewable unencoded image on a first surface (136) and an encoded image on an opposing surface (135). These substrates will be placed in the cavity (138) which is formed by the retainer (131) and the lens (132) in such a manner that the encoded images are adjacent the decoding lens (132) and the readily viewable unencoded images on the surface (136) are adjacent to the retainer (131). The plural decoding lens portions (134) will remain stationary and the plural substrates (136) will be moved about within the cavity (138) until the images borne on the first surface (136) of the plural substrates (133) form the desired image. The encoded images on the opposing surface (135) of the plural substrates (133) can also form a desired encoded image which can then be decoded with the decoding lens (132) and its one or more encoded image portions (134). A readily viewable image on the surface (136) can be formed independently or concurrently with the encoded image on the surface (135) as the plural substrates (133) are moved about within the cavity (138). In this manner, the decoder and viewer (130) can comprise one or two separate puzzles by virtue of the opposing readily viewable and unencoded image and the encoded image. The plural substrates (133) can bear unencoded readily viewable images on either or both of its surfaces (135) and (136).

While the decoders and viewers of the invention have been depicted as being single units, they can be combined to form puzzles comprising two or more viewers and/or decoders that have been attached to each other. For example, the decoder/puzzle (140) depicted in FIG. 18 comprises six individual decoders/puzzles (141–143) and (144–146) (not shown) which have been attached to each other to form a cube. Plural individual decoders/puzzles can also be combined, attached or connected to form other three-dimensional structures such as pyramids, rhombohedrons, other geometric forms and combinations thereof.

Figures 18, 19:
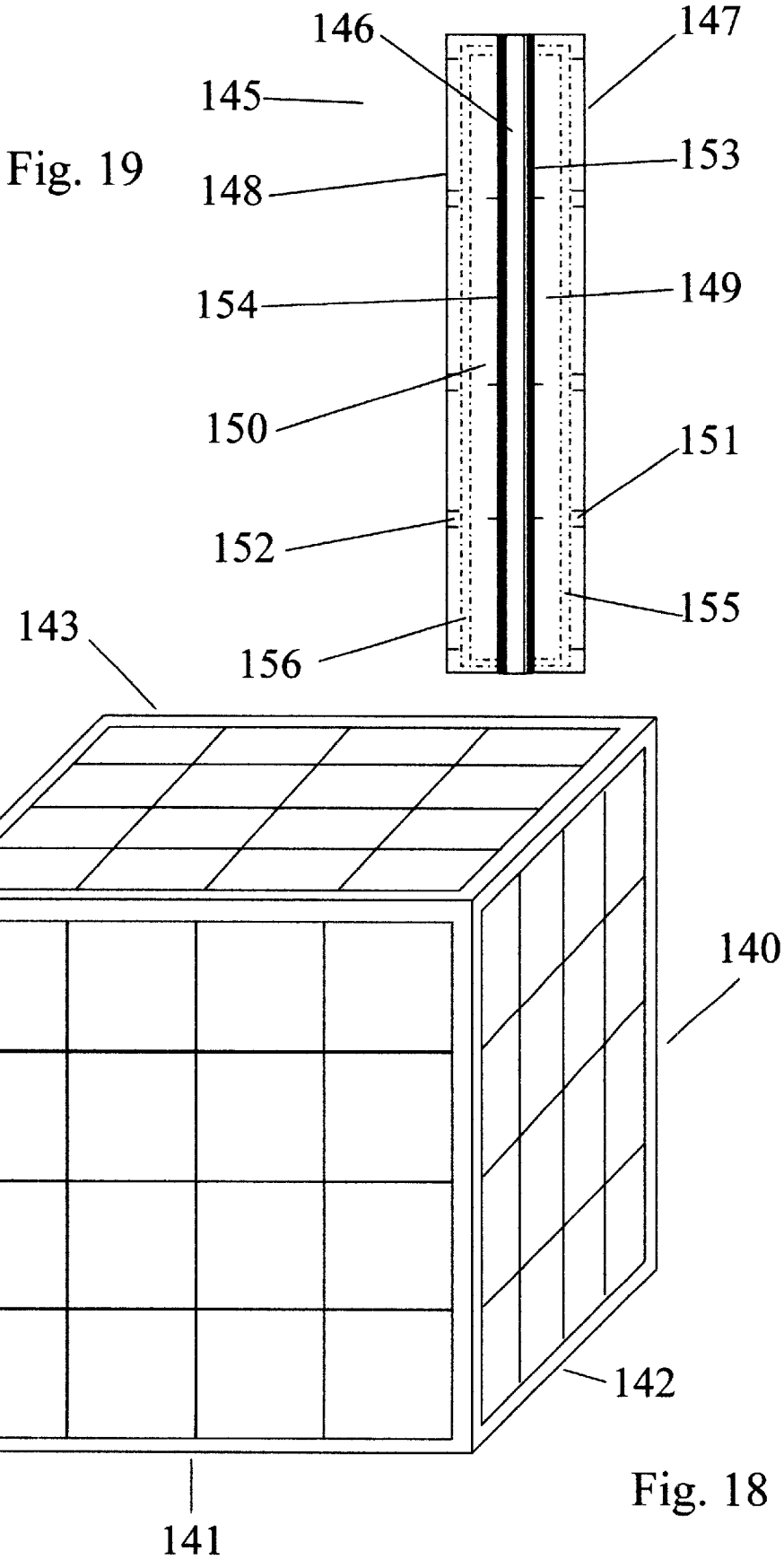
FIG. 18. Perspective view of an eleventh embodiment of the puzzle according to the invention wherein a three-dimensional object is formed from plural puzzles according to the invention.
FIG. 19. A side elevation of a twelfth embodiment of the puzzle according to the invention wherein two similar or different puzzles are joined back to back to form a combination puzzle.

The decoder of the invention can also comprise two individual puzzles/decoders that are attached to each other as depicted in FIG. 19. The puzzle (145) comprises individual puzzles (147) and (148) which are attached to opposing surfaces (153) and (154), respectively, of a substrate (146). The puzzles (147) and (148) can be the same or different and can have a construction similar to the decoder (20) depicted in FIG. 3*b*. Thus, an encoded image borne on a first surface (153) of the substrate (46) is viewable through and decodable with the plural decoding lenses (149) which are held adjacent the substrate (146) by the retainer (151). As with the other decoders of the invention, the substrate (146) of the decoder (145) can be made removable and replaceable. While not shown in the figures attached hereto, it is contemplated that the individual decoders and viewers of the invention can be attached to one or more of one another to create more complicated puzzle decoders.

Other slide puzzles such as those disclosed in U.S. Pat. No. 5,845,904, No. 5,470,065, No. 5,267,732, No. 5,116,053, No. 5,074,561, No. 4,949,969, No. 3,829,101, No. 5,529,301, No. 4,872,682, No. 4,269,414, No. 4,097,049, No. 5,060,948, No. 4,927,150 and No. 4,422,641 can be improved according to the invention. The puzzles all comprise a retainer and plural sliding pieces bearing image portions which form an assembled image when the pieces are located and oriented in the correct manner. Such puzzles can be improved by changing one or more of their sliding pieces into a decoding lens and placing one or more encoded images or encoded image portions on a surface of the retainer such that when the decoding lens superposes the encoded image (portion) a decoded image (portion) is formed. In this way, the invention also provides an improved slide puzzle comprising a retainer and plural sliding pieces held by the retainer, wherein one or more of the sliding pieces is a decoding lens and a surface of the retainer bears an encoded image which can be decoded and viewed by superposing the encoded image with the decoding lens.

Figure 14A:
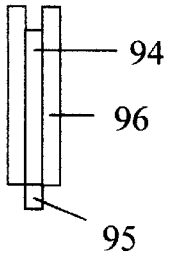
FIG. 14*a*. Side view of a second embodiment of a decoding lens according to the invention employing a tongue-and-groove mechanism for retaining adjacent lenses together.
Figure 14B:
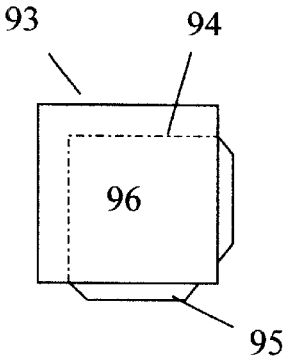
FIG. 14*b*. A top plan view of the decoding lens of FIG. 14*a*.
Figure 15A:
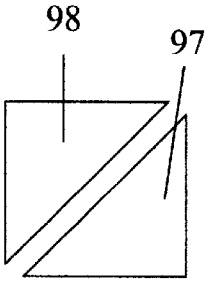
FIGS. 15*a* through 15*g*. Additional exemplary embodiments of the shapes for the decoding lenses according to the invention.
Figure 15B:
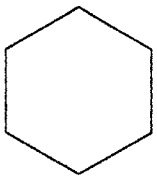
Figure 15C:
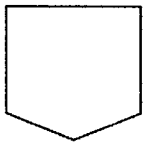
Figure 15D:
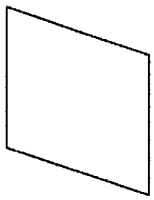
Figure 15E:
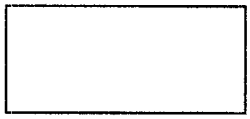
Figure 15F:
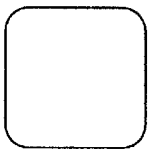
Figure 15G:
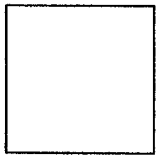

As used herein, the terms "retainer," "retaining means," and "retaining member" mean a structure or element which aids in the retention of one or more decoding lenses with the body of the decoder. The retainer can be integral with, separate from or attached to either the body, the individual decoding lenses or both. Since it is intended in some preferred embodiments that the decoding lenses will be in a slidable relation with either one or both the substrate or the body, the preferred retainer configuration will permit such a slidable relationship. For example, FIGS. 14*a* and 14*b* depict the decoding lens (93) which comprises an upper surface (96) and an opposing lower surface (unnumbered) and a groove (94) and a tongue (95) interposed the two surfaces. The groove (94) is disposed on two edges of the decoding lens (93) while the tongue (95) is disposed on two opposing edges of the decoding lens (93). In this embodiment, adjacent decoding lenses will be held together in close proximity, and, in combination with a second retainer that is either attached to or integral with the body, the decoding lenses will be retained with the body. The second retainer associated with the body can also employ a tongue-and-groove mechanism, or it can employ a capture mechanism whereby portions of the body overlay or overhang some of the edges of decoding lenses thereunder, thereby retaining the respective decoding lenses between the overhang from the body and the substrate or an opposing surface of the body.

As used herein, the term "encoded image" means an image having one or more encoded image portions which can be decoded with a decoding lens according to the invention to form an unencoded/decoded image or unencoded/decoded image portion. An encoded image can have within it a hidden, not readily discernible, masked, colored, light activated, heat activated, water activated, water revealable, chemical agent revealable, scrambled, unassembled, scattered, patterned, invisible, visible image or combinations thereof wherein when said image is viewed through a decoding lens according to the invention, an image is formed. The encoded image can require one or more different decoding lenses to form a decoded image. The encoded image can comprise graphics, markings, text, indicia, designs and combinations thereof. The decoded image can be an image of essentially any real or fictional person, place or thing. The encoded image can also be a part of an unencoded or readily discernible or readily viewable image, i.e., the encoded image can be hidden or masked by, embedded within or combined with a readily discernible or readily viewable image or portion thereof.

As used herein the term "viewing port" or "viewing portion" refers to an element of the decoder which is sufficiently translucent or transparent to permit a user of the decoder to view the decoding lenses or puzzle pieces within the decoder or viewer. Essentially any transparent or translucent material known to one of ordinary skill in the art can be used in the invention. In preferred embodiments, the viewing portion or viewing port will comprise transparent or translucent materials such as a screen, a cloth, a film, plastic, glass, rubber, paper, thermoplastic, polymer, and combinations thereof. The viewing port can be colored or colorless and itself can be a decoding lens according to the invention.

The term "lenticular lens-resolvable linear-patterned image" refers to a patterned image comprising a plurality of linear image-bearing sections which when properly viewed through a correspondingly designed lenticular decoding lens will form a decoded image or plural decoded image portions. The linear-patterned images can be but need not be substantially uniform in size. Although the linear-patterned encoded images depicted in some of the figures include straight and parallel linear image-bearing sections, the sections can be shaped as curved lines, geometrical shapes arranged linearly, and otherwise. It is only necessary that the linear-patterned encoded images be operable to cooperate with the lenticular lens to form a decoded image when the two are properly engaged. These patterned images can be Moiré patterned images. Such assembled images can indicate depth, motion, stereoscopic views, other such projections or dimensions, or combinations thereof. These patterned images are particularly useful for forming different images when viewed from different angles.

It is intended that the puzzle/viewer of the invention will facilitate momentary, semi-permanent and/or permanent viewing of an encoded image. Such viewing can be done without the need of a machine.

The substrate upon which an encoded image is disposed can comprise any suitable material which can bear said encoded image and examples include materials such as glass, metal, cloth, film, wood, ceramic, clay, plastic, cardboard, paperboard, rubber, polymer, paper, photographic film, transparency film or combinations thereof.

The decoding lenses and encoded-image-bearing substrates can be readily interchangeable. For example, a first group of decoding lenses can be used with any one of a variety of encoded image bearing substrates having different encoded images to form different decoded images.

The above is a detailed description of particular embodiments of the invention. It is recognized that departures from the disclosed embodiments may be made within the scope of the invention and that obvious modifications will occur to a person skilled in the art. Those of skill in the art should, in light of the present disclosure, appreciate that many changes can be made in the specific embodiments which are disclosed herein and still obtain a like or similar result without departing from the spirit and scope of the invention. All of the embodiments disclosed and claimed herein can be made and executed without undue experimentation in light of the present disclosure.

What is claimed is:

1. A viewer for viewing and decoding an encoded image, said viewer comprising:

a substrate having a first surface bearing an encoded image, wherein said encoded image comprises plural encoded image portions;

a body having opposing first and second surfaces and a receptacle for receiving or retaining said substrate;

plural slidable decoding lenses disposed along a plane and superposed said substrate for decoding respective ones of said encoded image portions on said substrate; and a first retainer in the body that slidably retains said slidable decoding lenses in slidable engagement with said body.

2. The viewer of claim 1 wherein said first retainer is integral with or attached to said body.

3. The viewer of claim 2 wherein a major portion of said first retainer superposes portions of said decoding lenses.

4. The viewer of claim 2 wherein said first retainer superposes edge portions of said decoding lenses and comprises plural edges defining one or more openings to permit a user of said viewer to contact said decoding lenses.

5. The viewer of claim 1 wherein said first retainer is adjacent said first surface of said body, said first surface of said substrate is adjacent a second surface of said body and said slidable decoding lenses interpose said first retainer and said substrate.

6. The viewer of claim 1 wherein said substrate is replaceable and removable from said viewer.

7. The viewer of claim 1 further comprising a second retainer that retains said decoding lenses with said body.

8. The viewer of claim 7 wherein said second retainer is substantially surrounded by said plural decoding lenses.

9. The viewer of claim 8 further comprising a decoding lens bypass for temporarily retaining one or more of said decoding lenses.

10. The viewer of claim 9 wherein said decoding lens bypass is adjacent said second retainer.

11. The viewer of claim 9 wherein said decoding lens bypass is attached to or integral with said body.

12. The viewer of claim 1 wherein said first retainer is integral with or attached to said slidable decoding lenses.

13. The viewer of claim 12 further comprising a second retainer that is integral with or attached to said body.

14. The viewer of claim 13 wherein said first retainer employs a tongue-and-groove joint.

15. The viewer of claim 13 wherein said substrate is replaceable and removable from said decoder.

16. The viewer of claim 13 further comprising a decoding lens bypass for temporarily retaining one or more of said decoding lenses.

17. The viewer of claim 16 wherein said decoding lens bypass is attached to or integral with said body.

18. The viewer of claim 16 further comprising a third retainer that is connected to said body or substrate, wherein said decoding lens bypass is adjacent said third retainer.

19. The viewer of claim 1 wherein at least a portion of said body is shaped as a cube, pyramid, rhombohedron, tetrahedron, orthorhombohedron, tetragon, diamond, triclinical-hedron, square, triangle, rectangle, parallelogram, hexagon, pentagon, polygon form having seven or more sides, circle, ellipse, sphere, hemisphere, regular form, irregular form, asymmetric form, symmetric form, cube, cylinder, frustoconical polygon, cone, rod, animal, person, thing, logo, extruded 2-dimensional form, multipointed star, caricature, fanciful figure and combinations thereof.

20. The puzzle of claim 1 wherein said puzzle further comprises one or more puzzle pieces retained by said retainer, wherein at least one of said puzzle pieces bears at least one of an encoded image, an unencoded image, a holographic image, an image-bearing member, a disc-shaped member, a hidden image, and combinations thereof.

21. The viewer of claim 1 wherein at least one of said decoding lenses further comprises an unencoded image portion which can be assembled with another unencoded image portion or with a decoded image to form another image.

22. An improved slide puzzle comprising a body slidably retaining plural sliding pieces in a plane in slidable relation to one another and the body and a retainer that slidably retains the sliding pieces with the body, the improvement comprising including decoding lenses as sliding pieces and including plural encoded image portions interposed a surface of the body and the sliding pieces wherein a decoded image is formed when the decoding lenses superpose the encoded image portions.

23. The improved slide puzzle of claim 22, wherein said slide puzzle is shaped as a plane, cube, sphere, egg, pyramid, polyhedron, cylinder, or polygonal structure.

24. The improved slide puzzle of claim 23, wherein at least two surfaces of the slide puzzle bear at least one decoding lens and one encoded image portion which is superposable by the decoding lens.

25. The improved slide puzzle of claim 23, wherein said slide puzzle comprises at least two slide puzzles that cooperate or operate independently of one another.

26. The improved slide puzzle of claim 25, wherein said at least two slide puzzles are disposed in a back-to-back relationship.

27. A viewer for viewing an encoded image comprising:

a body having a first surface;

an encoded image comprising plural encoded image portions and superposing said first surface of said body;

plural slidable decoding lenses superposing said encoded image; and a retainer in said body for retaining said decoding lenses with and in slidable relation to said body and for retaining said decoding lenses along a plane;

wherein at least one decoded image is formed when said slidable decoding lenses superpose respective ones of said encoded image portions.

28. The viewer of claim 27 wherein said plane is curved and said body comprises at least one substantially cylindrical portion superposed by said encoded image over which said decoding lens can slide radially or longitudinally.

29. The viewer of claim 27 wherein said body comprises at least two longitudinally adjacent substantially cylindrical portions, at least one of which is superposed by said encoded image, and over which at least two decoding lenses can slide radially or longitudinally, wherein said cylindrical portions are radially rotatable, are substantially coaxial and have approximately the same circumference.

30. The viewer of claim 29 wherein said retainer comprises two or more longitudinally spaced members at least one of which encircles adjacent sections of said at least two longitudinally adjacent substantially cylindrical portions.

31. The viewer of claim 29 wherein said retainer comprises two or more radially spaced members disposed longitudinally parallel to an axis common to said at least two longitudinally adjacent substantially cylindrical portions.

32. The viewer of claim 29 wherein said body comprises two longitudinally spaced and opposing end portions.

33. The viewer of claim 29 wherein said at least two longitudinally adjacent substantially cylindrical portions are held together by at least one connecting member.

34. The viewer of claim 33 wherein said at least one connecting member independently comprises at least one male connector and at least one female connector, wherein said male and female connectors are dimensioned to form a mating connection.

35. The viewer of claim 33 wherein the connecting member comprises one or more of a pressure fitting, threaded joint, snap-together joint, j-slot, adhesive, bearing, threaded slot, a rod and combinations thereof.

36. The viewer according to claim 27 wherein said retainer superposes portions of said decoding lenses.

37. The viewer of claim 27 wherein said encoded image is borne by at least one of said first surface of said body, a substrate interposed said decoding lenses and said first surface of said body, and combinations thereof.

38. The viewer of claim 27 wherein said encoded image is borne by a replaceable substrate interposed said decoding lenses and said first surface of said body.

39. A slide puzzle comprising:

a body;

a retainer attached to the body;

plural slidable decoding lenses in a first plane and in slidable engagement with the retainer such that the slidable decoding lenses are slidable in relation to the body, wherein the lenses are slidable with respect to one another and the first plane comprises an open area into which a decoding lens can slide;

an encoded image comprising plural encoded image portions in a second plane, wherein the first plane superposes the second plane;

wherein a decoded image is formed when the plural encoded image portions are viewed through respective ones of the slidable decoding lenses.

40. The slide puzzle of claim 39, wherein the body further comprises a first surface defined by a third plane, and the second plane superposes the third plane.

41. The slide puzzle of claim 40 further comprising a receptacle adapted to receive or retain a substrate bearing the encoded image.

42. The slide puzzle of claim 40, wherein the encoded image is borne by the first surface.

43. The slide puzzle of claim 39, wherein the decoding lenses comprise at least a first lenticular lens and a second lenticular lens and wherein the lenticules of the first lenticular lens have a different orientation than the lenticules of the second lenticular lens.

44. The slide puzzle of claim 39, wherein the number of slidable decoding lenses approximates the number of encoded image portions.

45. The slider puzzle of claim 39 wherein an encoded image portion is decodable with one or more than one slidable decoding lens.

* * * * *